US006098902A

United States Patent [19]

Culbertson et al.

[11] Patent Number: 6,098,902

[45] Date of Patent: Aug. 8, 2000

[54] SPRAY GUN FOR ATOMIZING AND APPLYING LIQUID COATINGS HAVING INTERCHANGEABLE NOZZLE ASSEMBLIES

[75] Inventors: Samuel William Culbertson, Boulder; Robert Ray Mellette, Nederland, both of Colo.

[73] Assignee: Coating Atomization Technologies, LLC, Boulder, Colo.

[21] Appl. No.: 09/312,119

[22] Filed: May 14, 1999

Related U.S. Application Data

[60] Provisional application No. 60/085,586, May 15, 1998.

[51] Int. Cl.[7] ..... B05B 1/28

[52] U.S. Cl. ..... 239/290; 239/391

[58] Field of Search ..... 239/390, 391, 239/296, 300, 290

[56] References Cited

U.S. PATENT DOCUMENTS

| | | | |
|---|---|---|---|
| 2,082,061 | 6/1937 | Jenkins | 299/140.1 |
| 2,544,123 | 3/1951 | Naemura . | |
| 2,743,963 | 5/1956 | Peeps . | |
| 3,791,579 | 2/1974 | Cowan | 239/3 |
| 4,252,768 | 2/1981 | Perkins et al. | 264/332 |
| 4,335,851 | 6/1982 | Hastings | 239/3 |
| 4,537,357 | 8/1985 | Culbertson et al. | 239/290 |
| 4,702,420 | 10/1987 | Rath . | |
| 4,759,502 | 7/1988 | Pomponi, Jr. et al. . | |
| 4,911,367 | 3/1990 | Lasley | 239/691 |
| 4,925,101 | 5/1990 | Konieczynski et al. . | |
| 4,934,603 | 6/1990 | Lasley | 239/527 |
| 5,064,119 | 11/1991 | Mellette | 239/8 |
| 5,209,405 | 5/1993 | Robinson et al. | 239/296 |
| 5,267,693 | 12/1993 | Dickey | 239/417.3 |
| 5,454,517 | 10/1995 | Naemura . | |

*Primary Examiner*—Christopher Kim
*Attorney, Agent, or Firm*—Sheridan Ross PC

[57] ABSTRACT

The present invention is a fluid spraying assembly wherein a plurality of differently configured spray guns can be constructed therefrom. The assembly includes fluid spray nozzles and air caps having different configurations and techniques for attaching to a resulting spray gun body. The assembly further includes intermediate components for operably connecting differently configured fluid spray nozzles and air caps to a spray gun body assembly that is substantially common for all resulting spray guns.

14 Claims, 7 Drawing Sheets

SPRAY GUN FOR ATOMIZING AND APPLYING LIQUID COATINGS HAVING INTERCHANGEABLE NOZZLE ASSEMBLIES

This application claims benefit of provisional application Ser. No. 60/085,586 filed May 15, 1998.

FIELD OF THE INVENTION

The present invention is related to a fluid spraying apparatus, and in particular, to such an apparatus that is capable of utilizing fluid spray nozzles and air caps from various manufacturers having potentially substantially different configurations and means for attaching such components to a spray gun body according to the present invention.

BACKGROUND OF THE INVENTION

There are numerous manufacturers of spray guns and associated components. In most cases, the spray guns and associated components for one manufacturer are not capable of being used with those of another manufacturer. Many industrial spray guns have at least the following three components:

(a) a spray gun body that is held by the operator or attached to a fixed or automatically movable support during spraying and to which a fluid and propellant source are attached;

(b) a fluid nozzle through which the fluid to be sprayed is ejected from the spray gun during spraying, and (c) an air cap for providing the propellant to assist in directionally propelling and atomizing the fluid into a spray, and additionally controlling the width or extent of the resulting spray pattern.

Moreover, it is not uncommon for these latter two components (i.e. the fluid nozzle and the air cap) to be the most important components for providing a desired spray pattern. Further, in some cases a single manufacturer may have different mounting configurations for these components on various models of spray guns. Heretofore there has been no spray gun body that allows these latter two components to be interchangeable and attachable to a single spray gun body. Accordingly, a spray gun operator may be required to use and maintain a number of different spray guns depending upon the manufacturer and configuration of the fluid nozzle and air cap that is desired to be used for a particular spraying task. Thus, it would be advantageous to have a spray gun assembly that allows the attachment of different fluid nozzles and air caps.

SUMMARY OF THE INVENTION

The present invention is directed to a spray gun assembly for atomizing and applying coatings, such as paint, adhesive, a protective or a destructive coating to a surface. In particular, the spray gun assembly can be used to construct a plurality of differently configured spray guns, wherein the spray guns atomize a fluid. More particularly, the fluid may be atomized using a propellant such as air ("air" being used as an exemplary propellant herein). The spray gun assembly of the present invention has interchangeable components that allow usage of different types of spray gun air caps and fluid nozzles, which together form the operable device referred to herein as the "spray nozzle." In particular, the present invention allows spray gun air caps and fluid nozzles of various configurations and/or from various manufacturers to be used with the spray gun assembly of the present invention.

In one aspect of the spray gun assembly of the present invention, it includes interchangeable carriers for thereby allowing any one of a plurality of fluid nozzles to be used even though the nozzles may have, e.g., different physical dimensions, different spray characteristics and/or different attachment characteristics (such as different diameters, and/or thread patterns). Accordingly, the present invention provides, for each of the fluid nozzles, a corresponding carrier for mating both to the remainder of the spray gun assembly of the present invention and to the fluid nozzle. Thus, fluid nozzles from different manufacturers and for different purposes may be used with the common spray gun assembly of the present invention for assembling a plurality of different spray guns.

Additionally, the present invention also includes interchangeable air cap attachment adapters, wherein for each of a plurality of different air caps, there is a corresponding such adapter that allows the spray gun assembly of the present invention to be assembled to obtain a spray gun utilizing the air cap. In particular, the air caps may be from different manufacturers and/or have different attachment characteristics, physical dimensions, and/or spray characteristics. Accordingly, the present invention allows the use of a variety of air cap and fluid nozzle combinations, each such combination having potentially different geometric configurations and different air (more generally, propellant) and fluid flow characteristics.

The spray gun assembly of the present invention is useful with either pressure feed or gravity feed spray gun configurations. Moreover, the present invention additionally is provided with a novel means for regulating air flow in the resulting spray guns. In particular, this means for regulating air flow utilizes, in one embodiment, (a) precisely sized orifice holes included in the above-mentioned corresponding nozzle carriers so that the atomizing air flow can be appropriately controlled, and (b) an orifice within an air passage that conducts air to be provided to the fan pattern shaping jets of differently configured air caps, for controlling and limiting air flow to the fan pattern shaping jets as one skilled in the art will understand. Thus, by utilizing this or an equivalent means for regulating air flow, the present invention can be used in constructing spray guns that compensate for different air pressures and different air flow volumes required by differently configured fluid nozzles and air caps, such as those from different manufacturers.

Other features and aspects of the present invention will become apparent in the detailed description and the accompanying drawings herein.

DETAILED DESCRIPTION OF THE PREFERRED EMBODIMENT

Figure 1:
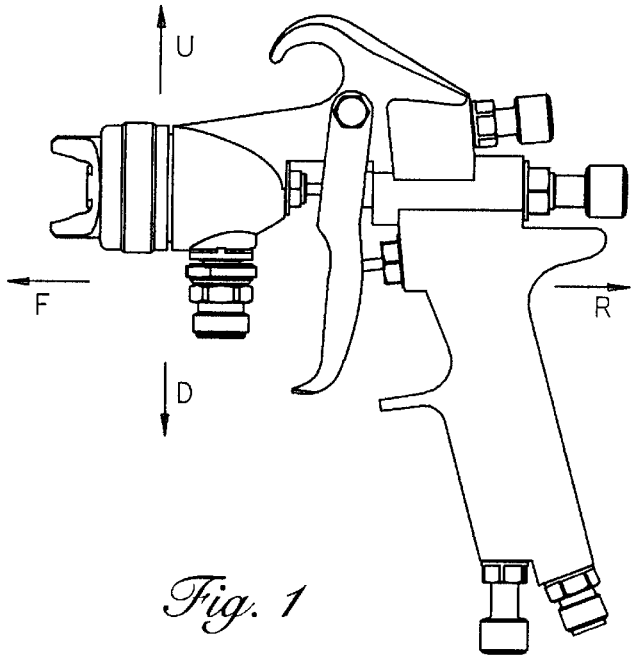
FIG. 1 is a side view of a spray gun 1 constructed from the present invention showing the general arrangement of the spray gun and its component parts.
Figure 2:
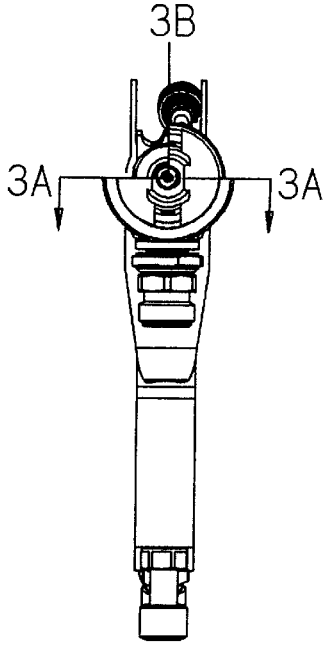
FIG. 2 is a front view of spray gun 1, wherein sectioning planes 3A and 3B are shown for illustrating internal components of the spray gun 1. In particular, the right angled section defined by a clockwise sweep from planes 3A to 3B cross sections all but the innermost components of the spray gun 1, and the right angled section defined by a counter-clockwise sweep from 3A to 3B cross sections only an outer layer of components.

In describing the present invention and a spray gun 1 configured therefrom, reference will be made to the labeled components of the accompanying figures. Note that the following terminology will be used herein:

(a) direction arrow U (FIG. 1) denotes the upward direction in relation to the spray gun 1;

(b) direction arrow D (FIG. 1) denotes the downward direction in relation to the spray gun 1;

(c) direction arrow F (FIG. 1) denotes the forward direction in relation to the spray gun 1;

(d) direction arrow R (FIG. 1) denotes the rearward direction in relation to the spray gun 1.

Figure 5:
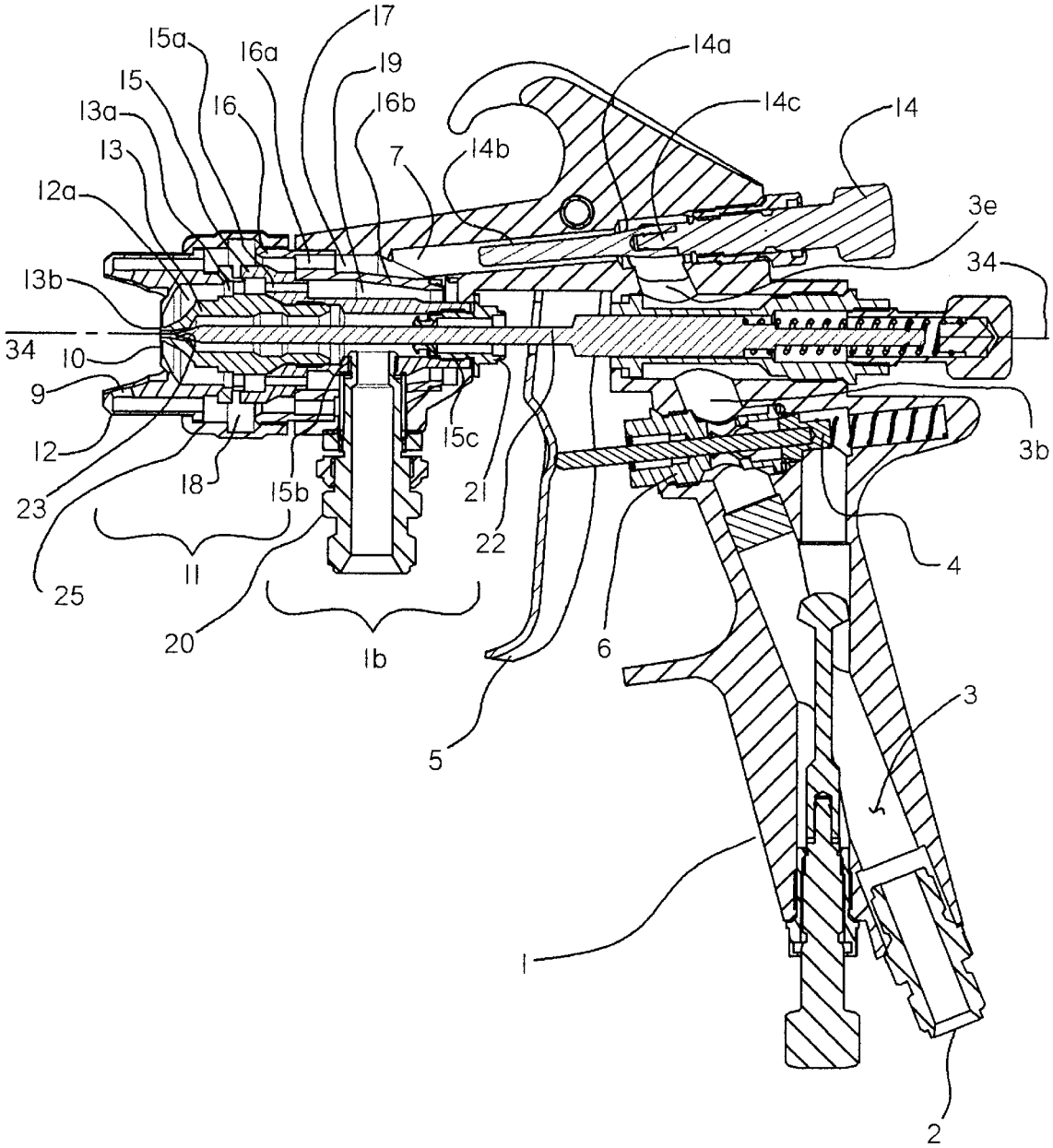
FIG. 5 is a cross-sectional side view of the spray gun 1 assembled from the spray gun assembly of the present invention showing, among other things, how an air cap adapter 16 and a fluid nozzle carrier 15 of the spray gun assembly connect an air cap 12 and a fluid nozzle 13, respectively, to the spray gun 1.
Figure 7:
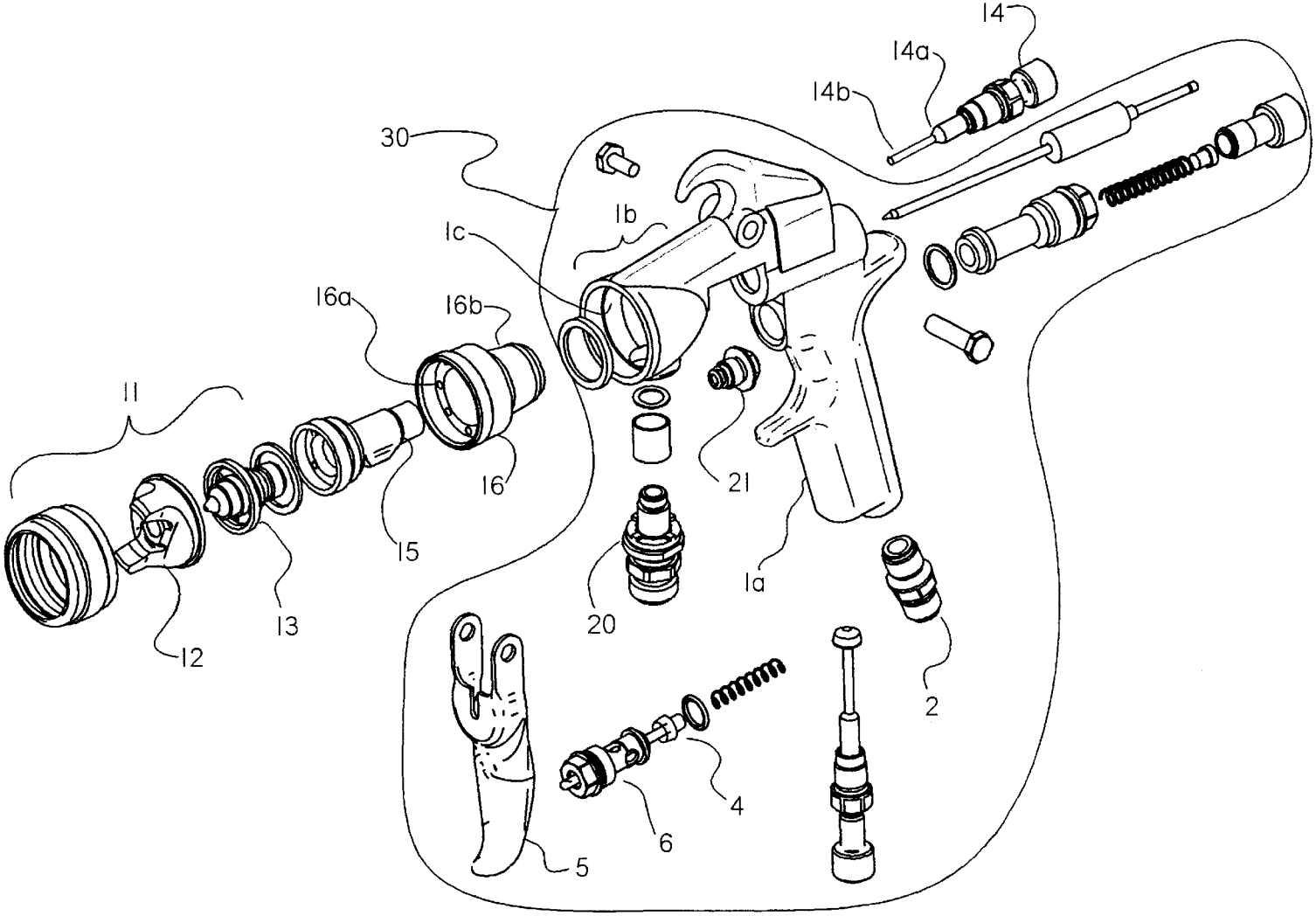
FIG. 7 is an exploded perspective view of the spray gun 1, wherein the general shape and relationship of components comprising the spray gun 1 are shown. In particular, this figure shows how the spray gun assembly components can be assembled to construct a plurality of different spray guns, wherein with the exception of the fluid nozzle carrier 15 and the air cap adapter 16, the other components of the spray gun assembly are reusable in spray guns having a different fluid nozzle 13 and/or a different air cap 12.

Referring to the exploded view of a spray gun 1 obtained from the present invention as shown in FIG. 7, and to the cross section of the spray gun 1 provided in FIG. 5, a novel spray gun body 1*a* provides support for other components of the spray gun 1. Note that the gun body 1*a* is one of the components of the spray gun assembly of the present invention. Air (or some other suitable compressed gas) under pressure enters the spray gun body 1*a* at the air inlet fitting 2 (also a component of the spray gun assembly) and travels upward through a drilled passage 3 to the back side (or inlet side) of an air valve 4 (also a component of the spray gun assembly). When the trigger 5 (also a component of the spray gun assembly) is pulled by a user, the air valve 4 opens thereby allowing air to flow through the air valve and into a continuation chamber 3*b* of the drilled passage 3 and subsequently into an upper part 3*e* of the gun body 1*a* as one skilled in the art will understand.

Figure 6:
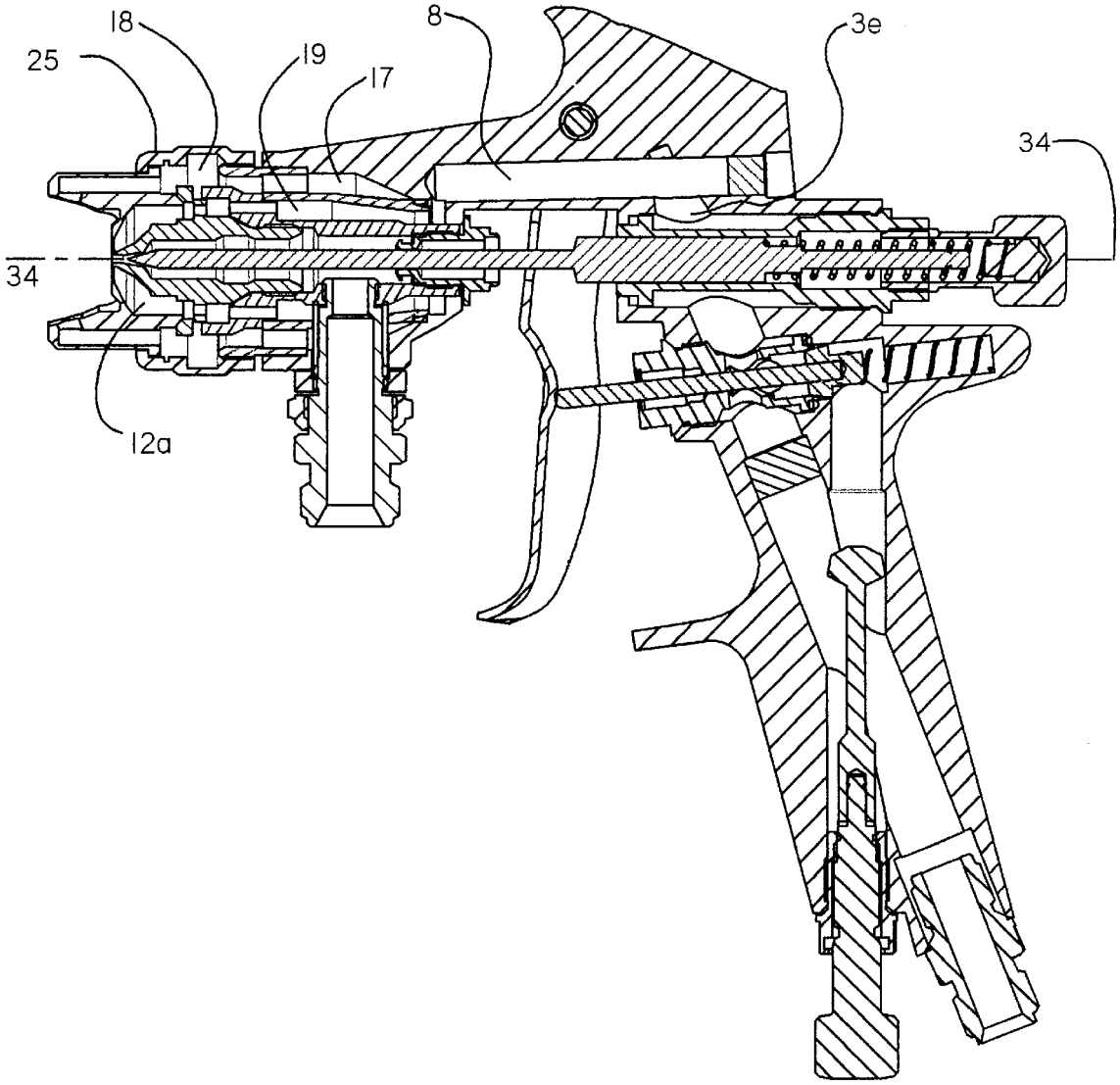
FIG. 6 is another cross-sectional side view of the present invention, wherein this view is provided for better illustrating air passage 8 and related structures.
Figure 8:
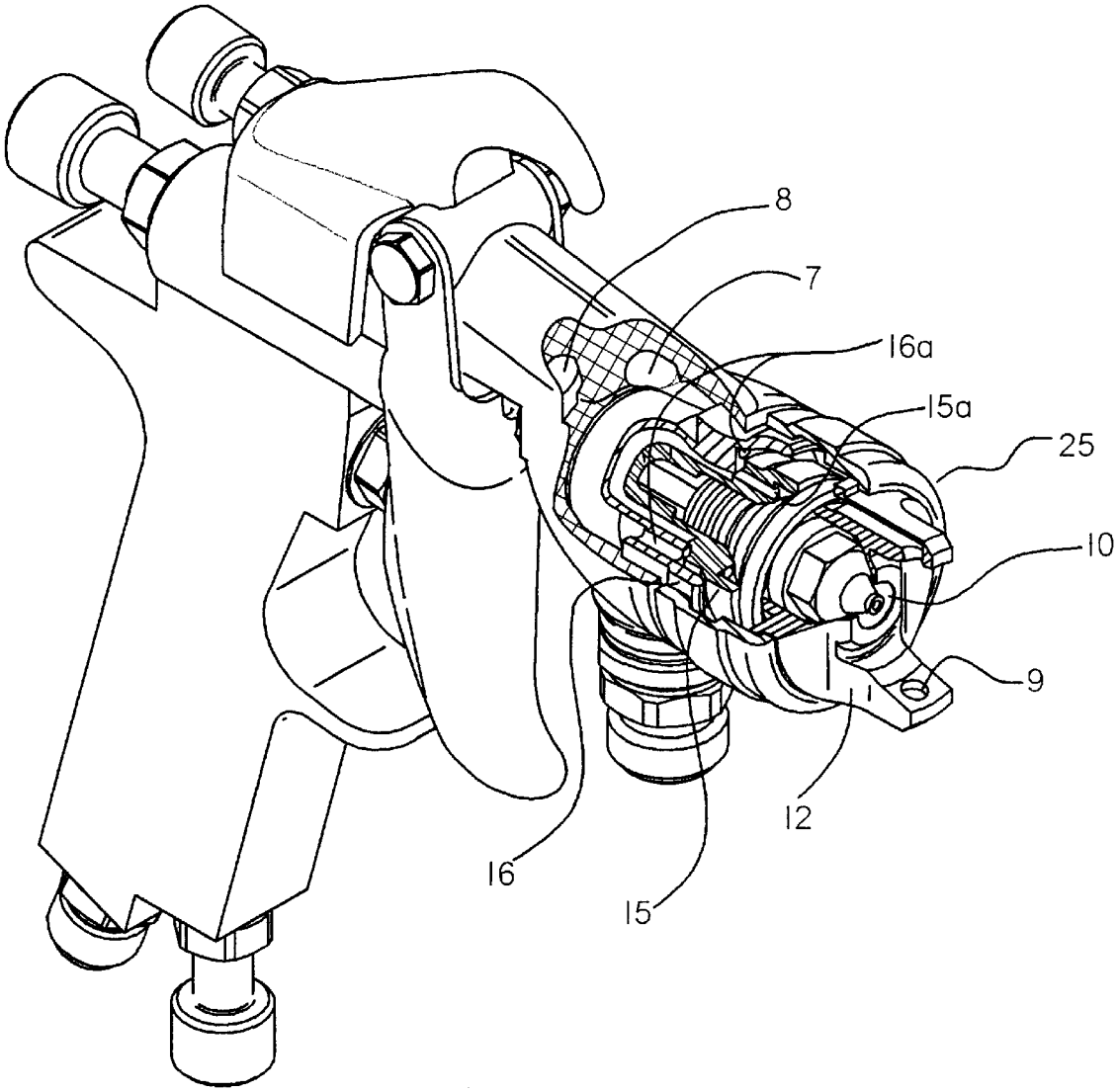
FIG. 8 is a perspective view of a spray gun assembled using components of the present invention, wherein a partial cutaway is provided for thereby illustrating the internal parts of the spray gun 1.
Figure 9:
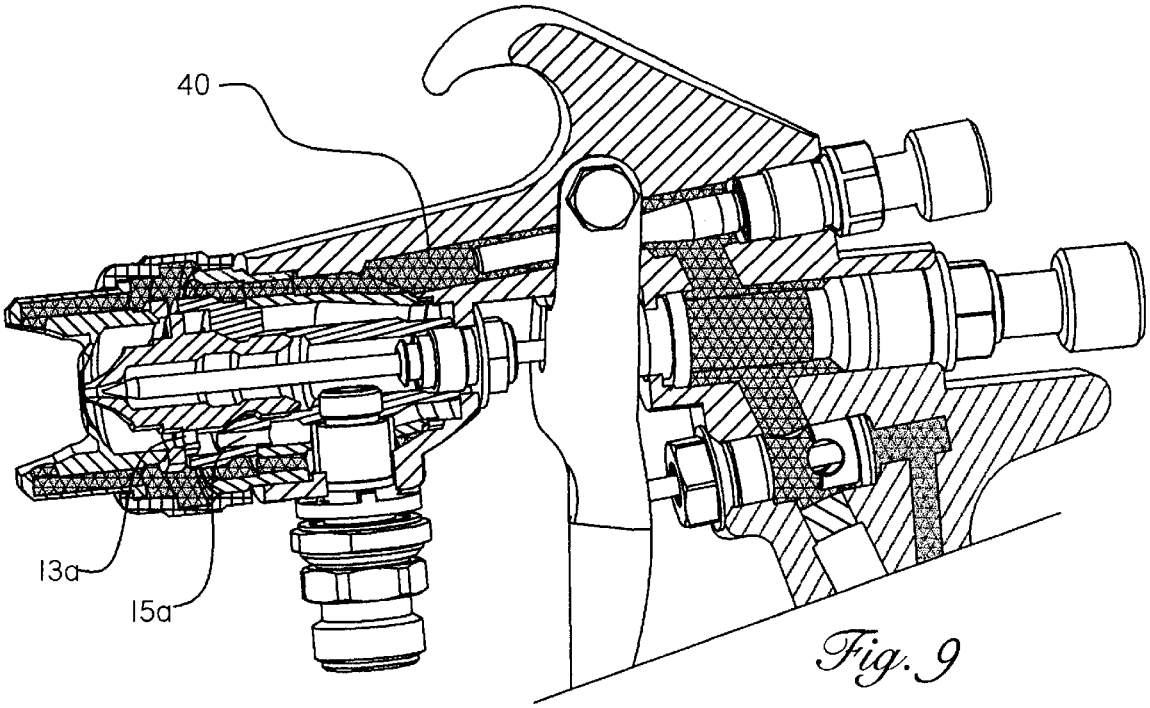
FIG. 9 is a cutaway view looking at the left front aspect of spray gun 1 to further illustrate the internal elements of the present invention.
Figure 10:
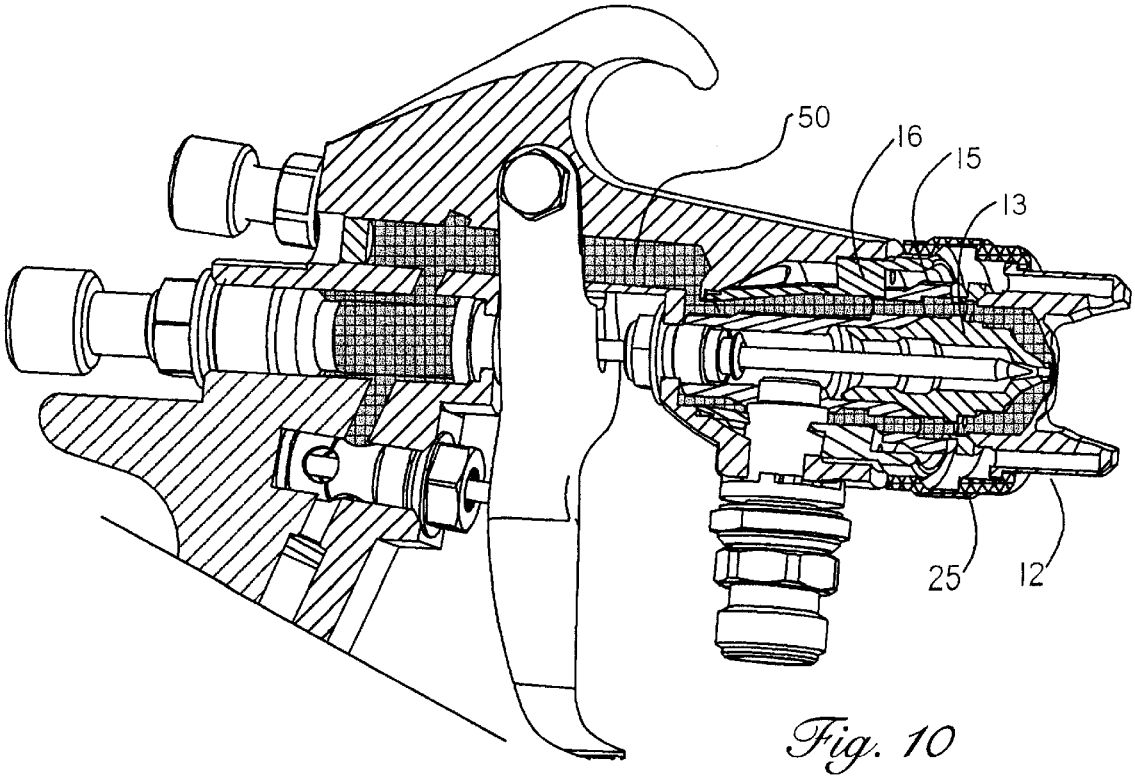
FIG. 10 is a cutaway view looking at the right front aspect of spray gun 1 to further illustrate the internal elements of the present invention.

The approximately vertically drilled passage 3 (FIG. 5) opens at the upper end of 3*e* into two parallel, roughly horizontal drilled air feed passages 7 (FIG. 5) and 8 (FIG. 6) in the spray gun body 1*a*, wherein the passages extend toward the forward end 1*b* of the gun body 1*a*. Note that this forward end 1*b* commonly is referred to as the "head" of the spray gun 1 provided by the present invention. The horizontal air passage 7 supplies air for the fan shaping air jets 9 (FIG. 8) of an interchangeable spray nozzle assembly 11 (air passage 7 being a portion of an air passageway 40 shaded in FIG. 9), wherein this assembly 11 includes an air cap 12, and a fluid nozzle 13. The horizontal air passage 8 supplies air to the center atomizing air jet 10 of the spray nozzle assembly 11 (air passage 8 being a portion of an air passageway 50 shaded in FIG. 10). Note that air flow through the (fan shaping) air passage 7 can be varied by adjusting the fan control knob 14 (alternatively known as the "side port control") which moves a needle valve 14*a* into the passage 7 for thereby restricting the air flow to the fan shaping air jets 9. Thus, by rotating the fan control knob 14 the needle valve 14*a* can be used to adjustably enhance or restrict the air flow through the passage 7. Accordingly the width of the resulting spray pattern generated by the spray gun 1 provided by the present invention, can be controlled and adjusted. Further, it is an aspect of the present invention that the fan control needle valve 14*a* includes a cylindrical stem 14*b* which can be permanently or removably joined to the rearward portion 14*c* of the needle valve 14*a*. The cylindrical stem 14*b* determines the maximum size of an annular air flow orifice within the drilled air passage 7 and surrounding the stem 14*b*, as is detailed further below. Accordingly, the stem 14*b* limits the air flow through the passage 7 to a predetermined maximum air flow rate for a given pressure. Thus, the needle valve 14*a* allows adjustment from the predetermined maximum, thereby controlling the spray pattern of spray nozzle 11 as noted above. Additionally, it is within the scope of the invention to limit the air flow through the passage 7 by other means that would be obvious to one skilled in the art, including for example replaceable orifice jets, adjustable needle valves, or mesh screens.

Further note that it is an aspect of the present invention that the fan control needle valve 14*a* is interchangeable within the spray gun body 1*a* and such interchangeability can be used to create differently calibrated or predetermined air pressure changes in the air passage 7. Moreover, since air passages 7 and 8 are both air outlets for upper part 3*e*, the valve 14*a* also provides air flow control through passage 8 that is inversely related to the air flow through passage 7. Thus, valve 14*a* provides a capability for balancing air flow between the spray nozzle assembly atomizing jet 10 and the fan shaping air jets 9. More precisely, by changing the diameter of the cylindrical stem 14*b* projecting into passage 7 the minimum amount of restriction to the air flow through passage 7 can be varied. Thus, the air pressure and air flow requirements for a number of spray nozzle assemblies 11 can be achieved in spray guns constructed from the present invention. Moreover, it is within the scope of the present invention to provide a needle valve or one or more other air flow orifice restriction components in each of the air passages 7 and 8.

Figure 3:
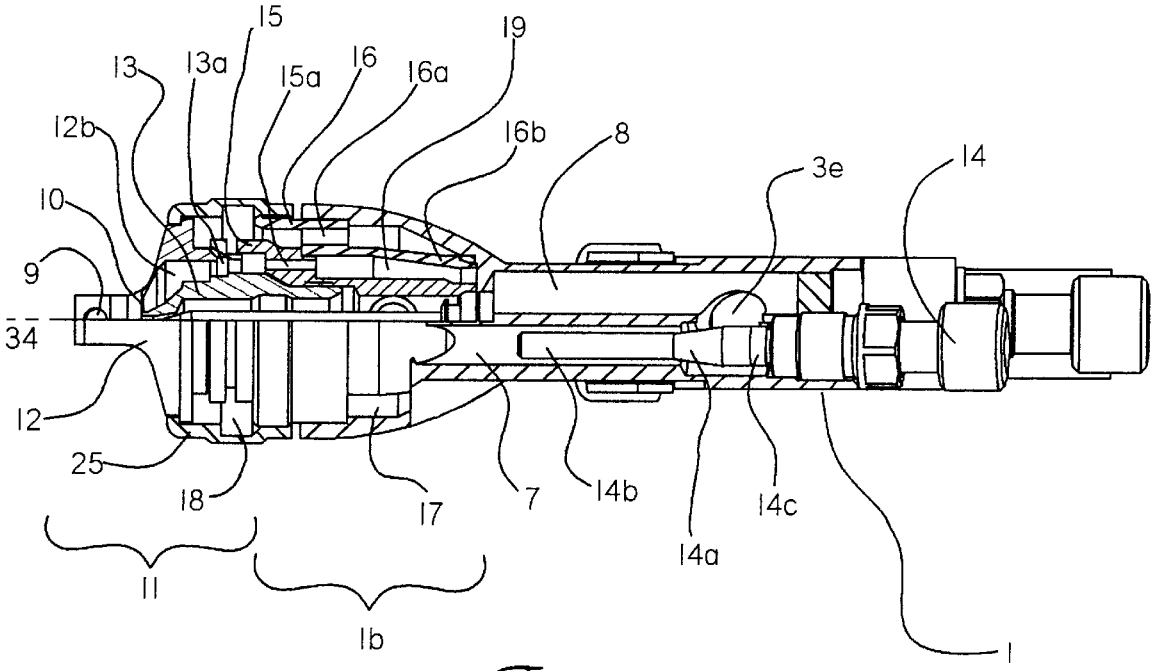
FIG. 3 is a top view of the spray gun as cut-away in FIG. 2 to further illustrate the internal components of the spray gun 1.
Figure 4:
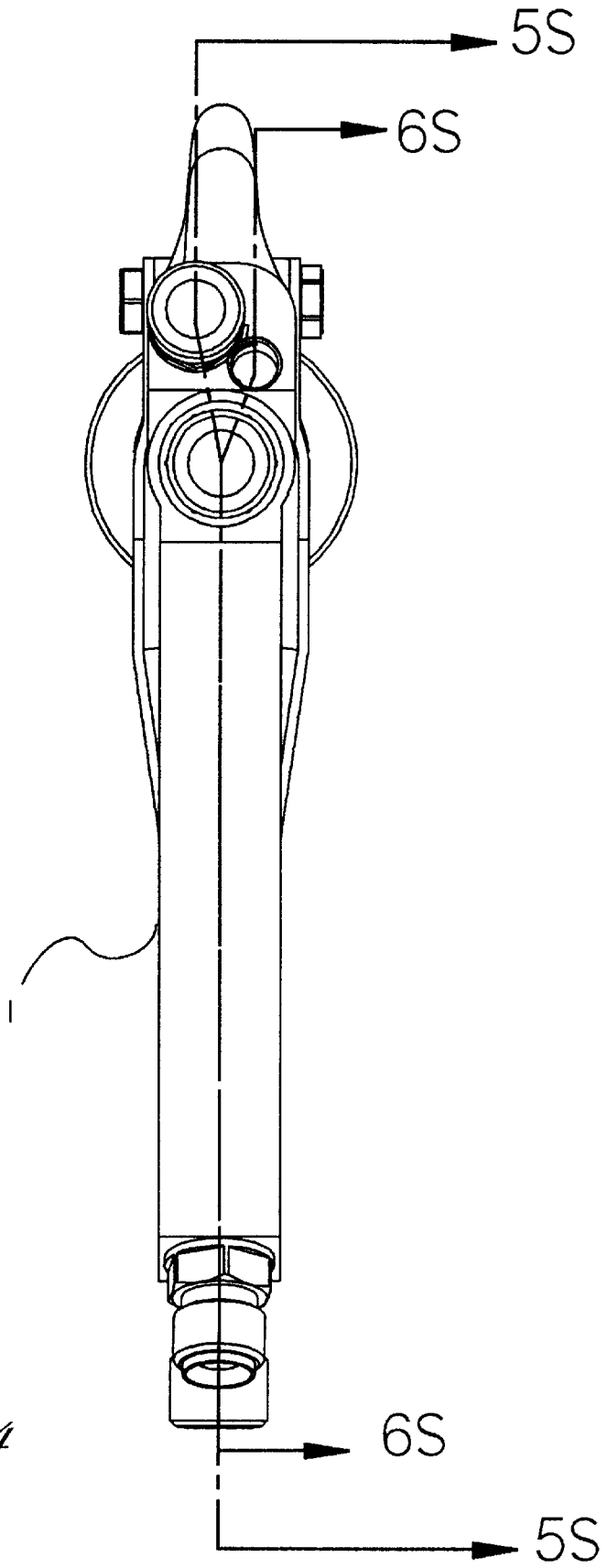
FIG. 4 is a rear view of the spray gun showing the sectioning planes 5S and 6S for the cross-sectional views in FIGS. 5 and 6, respectively.

Note that air flow from passage 8 to the spray nozzle atomizing jet 10 of the air cap 12 is also controlled by interchanging a first fluid nozzle carrier 15 for a different second such fluid nozzle carrier, wherein the air passages 15*a* (FIGS. 5 and 8) from the second carrier have different air flow capacities from that of the first carrier, as will be described in more detail below. Further note that the fluid nozzle carriers 15 are a novel feature of the present invention in that each such carrier functions as an intermediate component between (a) the components of the spray gun assembly that are reusable in substantially any spray gun 1 provided from the spray gun assembly of the present invention, and (b) one or more specific fluid nozzles 13 to which the carrier is designed to mate. That is, each such fluid nozzle carrier 15 connects a corresponding fluid nozzle to a spray gun body subassembly 30 (i.e., the assembled components identified by the encircled components of FIG. 7). Thus, a differently configured fluid nozzle 13 can be operatively attached to the same spray gun body subassembly 30 (also denoted as "body assembly" 30) by utilizing a second fluid nozzle carrier 15, wherein the second carrier 15 attaches to the body assembly 30 in the same manner as substantially every such carrier 15, but the second carrier 15 also includes the specific configuration necessary for operably attaching the differently configured fluid nozzle 13. Thus, it is an object of the present invention to not only provide variously configured spray guns 1, wherein various spray nozzle assemblies 11 (having different attachment characteristics, physical dimensions, and/or spray characteristics) can be attached, but also to provide the appropriate air flow characteristics required for each such spray nozzle assembly. Accordingly, as air exits the horizontal air feed passages 7 and 8, it is preferred that the air flow be evenly distributed to the air passages 13*a* in the fluid nozzle 13. Additionally, it is preferred that the air flow be evenly distributed to the air jets 9 in the air cap 12. Such even distributions of air flow are accomplished by the air cap adapter 16 (FIG. 7) and the fluid nozzle carrier 15 in conjunction with machined features noted below in the head 1*b* of the gun body 1*a*. The air cap adapter 16 has a cylindrical skirt 16*b* which extends rearwardly within the cylindrically formed, rearwardly tapering cavity 1*c* (FIG. 7) of the head 1*b* of the gun body 1*a*, thus separating this cavity into two co-axial chambers about the axis 34 (e.g., FIGS. 3 and 6) The outermost of these chambers (labeled 17 in FIGS. 5, 9 and 10) conveys air flow through a series of substantially evenly spaced holes 16*a* (about the axis 34) in the forward end of the air cap adapter 16, and subsequently the air flows into an annular chamber 18 formed between the rearward face of the air cap 12 and the forward face of air cap adapter 16, wherein the outer wall of the chamber 18 is formed by the air cap retaining ring 25 and the inner wall of the chamber is formed by the fluid nozzle 13. Accordingly, air flow from the passage 7 passes through the air cap adapter 16 and into the air cap 12 for subsequently exiting at the fan shaping jets 9.

Regarding the even distribution of air flow to the air passages 13*a* of the fluid nozzle 13, various styles of fluid nozzles 13 are capable of being adapted to the body assembly 30 by providing a different fluid nozzle carrier 15 for attachment thereto. Thus, the distribution of air flow to the air passages 13*a* of the fluid nozzle 13 (and ultimately to the center atomizing air jet 10) is provided by the innermost annular passage or chamber 19 (best shown in FIGS. 6 and 10) formed between the skirt 16*a* of the air cap adapter 16 and the fluid nozzle carrier 15. Accordingly, the passage 19 provides an even distribution of air flow to the calibrated openings 15*a* through the fluid nozzle carrier 15 which allow air to flow into the holes 13*a* (FIGS. 5, 6 and 10) in the fluid nozzle 13, as one skilled in the art will understand. Further, since the forwardly positioned ends of the holes 13*a* open into the center chamber 12*a* (FIG. 5) of the spray nozzle assembly 11, the air flow through these holes supplies a substantially uniform air pressure throughout the chamber 12*a*. Thus, air exiting through the annular center atomizing jet orifice 10 formed between the fluid nozzle tip 13*b* and the air cap 12 tends to be of a uniform speed and evenly distributed about the tip 13*b*.

During construction of a spray gun 1 according to the present invention, each such fluid nozzle carrier 15 is secured to the gun body 1*a* by threading the fluid inlet fitting 20 (FIGS. 5 and 7) into a threaded bore 15*b* of the fluid nozzle carrier 15. Additionally, a fluid needle packing nut 21 is provided so that when the fluid nozzle carrier 15 is fully inserted into the gun head cavity 1*c*, the packing nut 21 can be matingly threaded into the internally threaded end 15*c* (FIG. 5) of the fluid nozzle carrier 15, thereby further securing this carrier within the spray gun body 1*a*.

The spray gun body 1*a* also receives, in a known fashion, a fluid needle valve 22 (FIGS. 5 and 7), generally referred to as the "fluid needle" for those skilled in the art. This needle valve 22 is capable of being retracted along its longitudinal central axis (i.e., generally in direction R of FIG. 1) from its seat 23 (FIG. 5) within the fluid nozzle 13 when the trigger 5 is pulled by a user. Accordingly, when the trigger 5 is pulled, fluid (e.g. paint, adhesive or other similar fluids for coating a surface) is capable of being discharged from the nozzle tip 13*b* and thus exits this tip under pressure into the atomizing air stream of the air jet 10.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A fluid spraying apparatus, comprising: a body assembly having (a) through (c) following:

(a) a first passage for transporting a fluid for spraying to a first nozzle of a plurality of fluid nozzles capable of being interchangeably incorporated in said apparatus, wherein each said nozzle has an interior channel with a first end of the interior channel receiving the fluid and a second end of the interior channel providing an exit for the fluid from the apparatus during operation;

(b) a second passage for transporting a propellant to a chamber between an incorporated one of said fluid nozzles and an air cap, of a plurality of air caps capable of being interchangeably incorporated in said apparatus, wherein each said air cap substantially encloses a portion of said incorporated fluid nozzle adjacent the incorporated fluid nozzle's second end, and wherein an opening of said chamber adjacent said second end provides an exit for the propellant in a manner that enhances a transformation of the fluid into a spray;

(c) a third passage for transporting a spray controlling amount of the propellant, wherein said third passage transports the propellant at least partially along a path to one or more outlets that are arranged so that the propellant exiting said outlets contacts the spray exiting said chamber for changing the extent of the spray in a direction substantially traverse to a direction of the fluid exiting the first fluid nozzle;

a plurality of different fluid nozzle carriers, wherein each said carrier is capable of being interchangeably connected to said body assembly and to a corresponding one of said fluid nozzles so that a first intermediate passage within said carrier is provided between said first passage and the fluid nozzle for transporting the fluid;

a plurality of different adapters, wherein each said adapter is capable of being interchangeably connected to said body assembly for providing an extension of said third passage for transferring the propellant from said third passage to the outlets.

2. An apparatus as claimed in claim 1, wherein said one or more adapters are such that when attached to said body assembly and to one of said corresponding fluid nozzles, there is a propellant passage between said second passage and said chamber, and a separate passage between said third passage and said outlets.

3. An apparatus as claimed in claim 2, further including an air flow restricting component within at least one of said second passage and said third passage for controlling an amount of the propellant that flows through at least one of said second and third passages, wherein said air flow restricting component within said second passage includes a calibrated opening and said air flow restricting component within said third passage is a valve.

4. An apparatus as claimed in claim 1, wherein said body assembly includes a spray gun body, a trigger and an air valve in operable communication with said trigger for allowing both the fluid and the propellant to flow through a spray gun assembled from said apparatus.

5. An apparatus as claimed in claim 1, wherein a first of said carriers includes an opening through which the corresponding one of said fluid nozzles is received when said carrier and said corresponding fluid nozzle are assembled with said body assembly for spraying.

6. An apparatus as claimed in claim 1, wherein a first of said adapters has an opening through which one of said carriers is received when said first adapter and said one carrier are assembled with said body assembly for spraying.

7. An apparatus as claimed in claim 1, wherein at least one of said carriers, when operably connected to said body assembly, provides an extension of said second passage for transferring the propellant from said second passage to said chamber.

8. An apparatus as claimed in claim 1, wherein at least one of said adapters, when operably connected to said body assembly, separates an extension of said second passage, and an extension of said third passage from one another.

9. An apparatus as claimed in claim 1, further including a first means for restricting the flow of air through said second passage, wherein said first means for restricting is within said second passage and said first means for restricting is replaceable with a second means for restricting, wherein said first means for restricting and said second means for restricting is a calibrated opening.

10. An apparatus as claimed in claim 1, further including a first means for restricting the flow of air through said third passage for restricting the flow of air through said third passage, wherein said first means for restricting is within said third passage and said first means for restricting is replaceable with a second means for restricting.

11. A spray gun assembly, comprising:

a body assembly for providing a fluid to be sprayed and a propellent for atomizing the fluid;

a first nozzle carrier, connecting between said body assembly and a first fluid nozzle, for transferring at least the fluid from the body assembly to the first fluid nozzle;

a second nozzle carrier for replacing said first nozzle carrier, and connecting between said body assembly and a second fluid nozzle, differently configured from said first fluid nozzle, for transferring at least the fluid from the body assembly to the second fluid nozzle;

a first adapter connecting between said body assembly and a first air cap for transferring the propellent from said body assembly to one or more propellent outlets of the first air cap;

a second adapter for replacing said first adapter and for connecting between said body assembly and a second air cap, differently configured from the first air cap, for transferring the propellent from the body assembly to one or more propellent outlets of the second air cap.

12. A spray gun assembly as claimed in claim 11, wherein said first nozzle carrier is replaced with said second nozzle carrier, said first adapter is also replaced with said second adapter when configuring a resulting spray gun operable for spraying the fluid.

13. A method for assembling a spray gun, comprising: providing a body assembly having at least some of:

a grip, a trigger and a fluid passageway for a fluid to be sprayed, and a propellant passage for a propellant used in atomizing the fluid;

first selecting a first fluid nozzle from a plurality of differently configured fluid nozzles;

second selecting a first air cap from a plurality of differently configured air caps;

first determining a first fluid nozzle carrier that mates with said first fluid nozzle, operably connecting said first fluid nozzle to said body assembly for transferring at least the fluid to the first fluid nozzle;

second determining an adapter that mates with the first air cap, operably connecting said first air cap to said body assembly for transferring the propellant to the first air cap.

14. A method as claimed in claim 13, further including the steps of:

third selecting a second fluid nozzle from a plurality of differently configured fluid nozzles; and third determining a second fluid nozzle carrier that mates with said second fluid nozzle operably connecting said second fluid nozzle to said body assembly; and replacing said first fluid nozzle and said first fluid nozzle carrier by said second fluid nozzle and said second fluid nozzle carrier, operably connecting to said body assembly for configuring the spray gun.

* * * * *